US008273280B2

(12) United States Patent
Jonsson

(10) Patent No.: US 8,273,280 B2
(45) Date of Patent: Sep. 25, 2012

(54) METHOD FOR THE PRODUCTION OF A THIN-WALLED FLEXIBLE PLASTIC TUBE WITH LABEL

(75) Inventor: Sven-Ake Jonsson, Varnamo (SE)

(73) Assignee: Tectubes Sweden AB, Astorp (SE)

( * ) Notice: Subject to any disclaimer, the term of this patent is extended or adjusted under 35 U.S.C. 154(b) by 0 days.

(21) Appl. No.: 12/908,049

(22) Filed: Oct. 20, 2010

(65) Prior Publication Data

US 2011/0031646 A1 Feb. 10, 2011

Related U.S. Application Data

(62) Division of application No. 10/591,123, filed as application No. PCT/IB2005/000983 on Mar. 2, 2005, now abandoned.

(30) Foreign Application Priority Data

Mar. 3, 2004 (SE) ..... 0400518

(51) Int. Cl.
*B29C 45/14* (2006.01)

(52) U.S. Cl. ..... 264/275; 264/135

(58) Field of Classification Search ..... None
See application file for complete search history.

(56) References Cited

U.S. PATENT DOCUMENTS

| | | | | |
|---|---|---|---|---|
| 5,242,650 | A | 9/1993 | Rackovan | |
| 5,819,991 | A * | 10/1998 | Kohn et al. | 222/215 |
| 5,850,940 | A | 12/1998 | Sloan et al. | |
| 5,925,208 | A * | 7/1999 | Dronzek, Jr. | 156/257 |
| 5,968,443 | A * | 10/1999 | Robles et al. | 264/509 |
| 6,588,178 | B1 | 7/2003 | Kieras | |
| 2002/0139707 | A1 | 10/2002 | Hakansson | |

FOREIGN PATENT DOCUMENTS

| | | |
|---|---|---|
| EP | 0 313 400 | 10/1988 |
| WO | 93/04842 | 3/1993 |
| WO | 93/09925 | 5/1993 |
| WO | 98/01285 | 1/1998 |
| WO | 03/099544 | 12/2003 |

* cited by examiner

*Primary Examiner* — Edmund H. Lee
(74) *Attorney, Agent, or Firm* — Young & Thompson

(57) ABSTRACT

A thin-walled plastic tube having an axial direction and a radial direction is manufactured by injection moulding and includes a tube body with a tube shoulder with an emptying opening at a first end and an end closure at a second end, the tube body having a wall thickness of 0.3-1.2 mm. The plastic tube includes a label applied simultaneously with the injection moulding, the label having a plastic film with a tensile strength in the axial direction of the tube which is at least 100 N/mm$^2$, preferably at least 150 N/mm$^2$, and most preferably at least 210 N/mm$^2$ measured according to DIN ISO 527-1/-3, an elongation at break which is at most 70%, preferably at most 50%, and most preferably at most 25% measured according to DIN ISO 527-1/-3, and a thickness of at most 90 μm and preferably of at most 75 μm.

3 Claims, 2 Drawing Sheets

METHOD FOR THE PRODUCTION OF A THIN-WALLED FLEXIBLE PLASTIC TUBE WITH LABEL

CROSS REFERENCE TO RELATED APPLICATIONS

This application is a divisional of application Ser. No. 10/591,123 filed on Oct. 30, 2006, now abandoned, which is the 35 U.S.C. §371 national stage of International PCT/IB2005/000983 filed on Mar. 2, 2005, which claims priority to Swedish Application No. 0400518-7 filed on Mar. 3, 2004. The entire contents of each of the above-identified applications are hereby incorporated by reference.

TECHNICAL FIELD

The invention relates to a thin-walled plastic tube having an axial direction and a radial direction, the plastic tube being manufactured by injection moulding and comprising a tube body with a tube shoulder and an emptying opening at a first end and an end closure at a second end, the tube body having a wall thickness of 0.2-1.5 mm.

BACKGROUND ART

Tubes made of thin, flexible plastic are used for a range of different packaging purposes, such as packaging hygiene articles, cosmetics and foods. The contents of such tubes may consequently be, for example, soft cheese, caviar, hair-styling gel, toothpaste, shampoo, lotion or liquid soap. The tube should have a smart appearance so as to be visually appealing on the shop shelf. For hygiene articles and cosmetics, it is moreover important that the tube looks attractive and decorative, for example on a bathroom shelf. It is also important that the outside of the tube is of such a nature that product information is conveyed in a clear and easily understood way to a purchaser or user of the packaged product. For these reasons, tubes are usually provided with direct printing or a label which can be printed with the desired pattern and text.

One way of applying labels to containers is by what is known as "in-mould-labelling", IML, that is to say by melting a label on at the same time as the container is formed by injection into a mould. IML affords a number of advantages, both with regard to the appearance of the finished container and during manufacture of the container. For example, it is possible to produce a glossy or matt label surface which can have the effect of giving the container an elegant appearance. It is also possible to reduce changeover times considerably when a label is changed, as a result of which shorter product runs can be manufactured at a reasonable cost and delivery times to the customer can be reduced.

It has consequently become increasingly common to apply labels to different types of injection-moulded container using the IML technique. However, it has proved to be difficult to achieve a good result with IML in the manufacture of injection-moulded thin-walled tubes as these require very great compressive forces and injection speeds which result in a high rate of breaking and other damage to the labels. In order not to have a negative effect on the flexibility of the tube, the material of the labels used moreover has to be very thin, which further increases the risk of the label breaking during tube manufacture. The small wall thickness of the tubes also means that the heat transfer from the plastic melt to the label is small, which means that the label has to be thin in order to be capable of being melted onto the tube during the manufacturing process.

As the IML technique affords many advantages, such as better pliability of the label around edges and irregularities on a container and a greater possibility of achieving full coverage of the container, it is desirable for it to be possible to use IML for thin-walled tubes as well.

DISCLOSURE OF INVENTION

A thin-walled plastic tube of the kind referred to in the introduction has been produced by means of the present invention. A tube according to the invention with a tube body provided with a label is in this connection characterized mainly in that the plastic tube comprises a label applied simultaneously with the injection moulding, the label comprising a plastic film with a tensile strength in the axial direction of the tube which is at least 100 N/mm$^2$, preferably at least 150 N/mm$^2$, and most preferably at least 210 N/mm$^2$ measured according to DIN ISO 527-1/-3, an elongation at break which is at most 70%, preferably at most 50%, and most preferably at most 25% measured according to DIN ISO 527-1/-3, and a thickness of at most 90 μm and preferably of at most 75 μm.

By ensuring that the label material has great tensile strength in the axial direction of the tube, that is to say in the longitudinal direction of the tube, it has been found to be possible to label thin-walled plastic tubes as well using the IML technique with very good results and little waste. As mentioned previously, injection moulding of thin-walled plastic tubes requires the molten plastic to be pressed into the mould at a very high speed, which results in great stresses on the label material, which is retained electrostatically or by vacuum on the inside of the mould during the injection stage. These stresses are greatest in the axial direction, while the label is affected less in the radial direction, that is to say in the circumferential direction of the tube body.

It is furthermore essential that the plastic tubes are thin and flexible, so that it is easy to squeeze out their contents and to achieve a high degree of emptying of the tube. For this reason, it is important that the label material contributes as little as possible to the thickness of the tube wall. It is consequently desirable that the label material is very thin, which of course further limits the choice of usable materials.

A thin-walled plastic tube according to the invention suitably has a label comprising a plastic film with a tensile strength in the radial direction of the tube of at least 50 N/mm$^2$, preferably at least 80 N/mm$^2$, and most preferably at least 120 N/mm$^2$, and an elongation at break of at most 250%, preferably at most 200%, and most preferably at most 110%.

According to one embodiment of the invention, the label extends around the entire tube body in the radial direction. By using the IML technique and selecting a label material with the appropriate tensile strength and extensibility, it is possible to apply a label so that it completely surrounds the tube in the radial direction without leaving a gap between the label edges or the label edges overlapping one another. It is thus possible to produce a continuous pattern, or an unbroken text which runs radially around the tube body, without a visible join between the label edges.

It may furthermore be suitable for the label to cover the entire tube body in the axial direction, that is to say from the shoulder edge to the end closure. This is because it is desirable for many packaging purposes that the contents of the tube are not visible through the tube wall. The label can then be used to cover the entire tube body, something which has not been possible with the labelling technique previously used for thin-walled plastic tubes. The invention consequently makes it possible to conceal the contents of tubes made of transparent plastic as well.

The only method which could be used for labelling thin-walled plastic tubes until now involved attaching the labels after the moulding of the finished tubes. This of course involves difficulties in the form of synchronization problems. The label materials suitable for subsequent application are moreover not weldable, which means that it is necessary to ensure that they do not extend into the end closure of the tube, which is usually a thermal weld. The label materials are furthermore relatively rigid, which makes it necessary for the label to end a little way below the edge between the tube body and the tube shoulder. A conventional, subsequently applied tube label which extends up too close to the transition between the tube body and the tube shoulder may otherwise bulge from the tube wall or form a creased edge. This phenomenon should of course be avoided as it gives the tube an unattractive appearance.

In accordance with the invention, however, it is possible to have the label extend in the axial direction of the tube all the way into the end closure on the tube body. The label materials used in the IML method are thermoplastic and, like the plastic material of the tube body, fully weldable and do not affect the possibility of achieving a good closure at the end of the tube. This also means that it is possible to achieve full coverage of the tube body with the label even when the end closure of the tube body has a non-linear curved shape or an angular shape. With subsequently applied labels, shape adaptation to a non-linear end closure requires a degree of synchronization which in practice makes such labelling impossible. Non-linear end closures are used for decorative reasons and in order to give the tube a designed appearance, something which may be desirable in the packaging of cosmetics or the like. A non-linear end closure can also advantageously be used for forming a wider welded-together portion in which an opening or hook can be arranged, which serves as hanging means for the tube, on a shop shelf or in a bathroom for example.

It is also possible to have the label extend in the axial direction of the tube over the edge between the tube body and the tube shoulder. When the IML technique is used, the label is moulded together with the material of the tube wall, and the phenomenon of different shrinkage between the tube wall and the label does not occur. Instead, the label closes tightly around the tube body in a pliable way without a transparent gap arising between the label and the edge between the tube shoulder and the tube body.

With a label according to the invention, it is consequently possible to achieve considerably better coverage of the surface of the tube, as a result of which the printable area is larger than was previously possible to achieve. Advantages are moreover achieved both in purely aesthetic terms and in terms of processability, for example weldability and the avoidance of synchronization problems.

A suitable material for use in a label according to the invention is a multilayer plastic film comprising at least one layer of oriented polypropylene (OPP).

Such a plastic film has a considerably greater tensile strength and lower tensile yield limit in the orientation direction than in a direction at right angles to the orientation direction and is applied to the thin-walled tube with the orientation direction coinciding with the axial direction of the tube.

The plastic film used in the label suitably has a density of between 0.4 and 1.2 g/cm$^3$ and preferably between 0.5 and 1.0 g/cm$^3$.

The tube itself is made from thermoplastic polymer material which is injected into a mould. There are different requirements for the different parts of tubes. In order to facilitate extraction of material from the tube body, this must be sufficiently flexible to be compressed with moderate pressure. The tube shoulder should be rigid enough that the hole will not collapse and thus prevent extraction of material. If the tube is provided with an integrated closing device, for example a hinged lid, the closing device should be relatively rigid in order to provide good functioning when the lid is opened and reclosed. In those cases where the tube has a hinge which connects the tube shoulder and the closing device, further specific material properties are required. The material of the hinge must have such properties that it will withstand repeated bending to and fro without breaking.

Owing to the different and sometimes conflicting properties which are required for the different parts of a tube, tubes are often manufactured in separate parts which are joined together to form a whole. The tube body is made from a more flexible material, and the closing device from a more rigid material, and the two parts are joined together in a subsequent manufacturing step. It is also possible, however, to manufacture the parts simultaneously, by injecting different plastic types into different parts of a mould, as described in WO 03/099544. With such a procedure, it is possible to produce a plastic tube in one process step with parts having different properties, such as different rigidity and flexibility and different transparency.

DESCRIPTION OF FIGURES

The invention will be described in greater detail below with reference to the figures shown in accompanying drawings, in which.

ILLUSTRATIVE EMBODIMENTS

Figure 1:
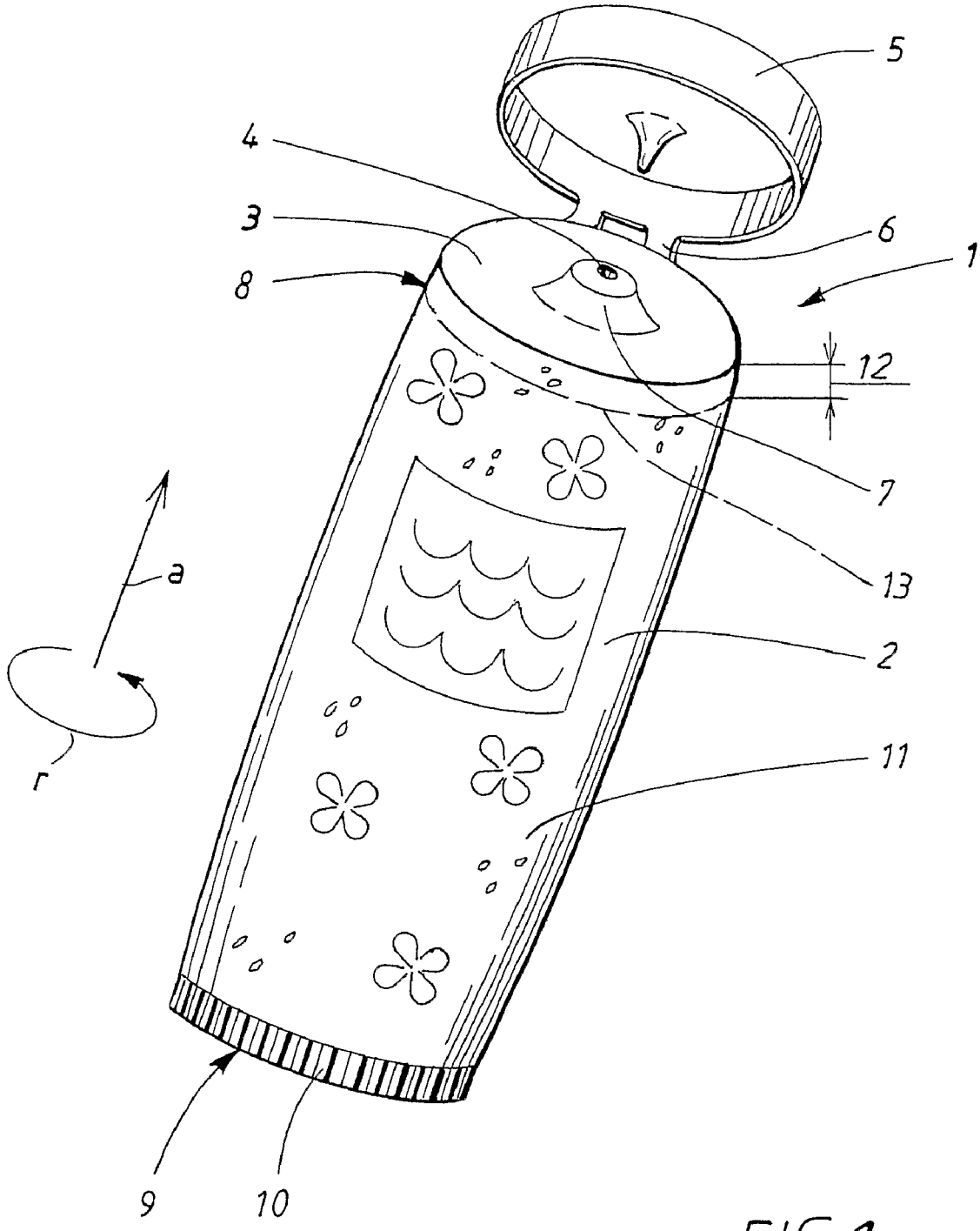
FIG. 1 shows a tube according to a first embodiment of the invention.

The tube 1 shown in FIG. 1 comprises a hollow tube body 2, a tube shoulder 3 with a dispensing opening 4 for dispensing a product packaged in the tube 1. The tube 1 also has a lid 5 which is connected in an articulated manner to the tube shoulder 3 via a hinge joint 6. The dispensing opening 4 is arranged in a raised portion 7 on the tube shoulder 3. The tube shoulder 3 is located at a first end 8 of the tube body 2, while the opposite end 9 of the tube body 2 has an end closure 10.

The tube body 2 of the plastic tube 1 consists of an injection-moulded tubular plastic part with a wall thickness of 0.3-1.2 mm. The lid 5, the hinge joint 6 and the tube shoulder 3 are also formed by injection moulding, at the same time as the tube body 1, but have a greater material thickness than the tube body. The tube 1 can be made from polyethylene or polypropylene, for example, but, as there are different requirements for different parts of the tube, it is often advantageous to adapt the material of the tube accordingly. Consequently, the tube body 2 suitably consists of polyethylene or polypropylene, while the tube shoulder 3 consists of a fusion of polyethylene and polypropylene, and the lid 5 and the hinge 6 consist of polypropylene. Even if the whole tube 1 is formed in the same manufacturing operation, it is consequently not necessary for the different parts to be made from the same type of plastic. It is possible, for example, to make the lid 5 and the tube shoulder 3 from non-transparent plastic, while the tube body 2 is made from a transparent plastic.

After the tube 1 has been filled with its contents, the tube has been sealed, suitable by a thermal weld 10.

As shown in FIG. 1, the majority of the outer surface of the tube 1 is covered by a label 11. The label 11 extends all the way from the edge 13 between the tube shoulder 3 and the tube body 2 at the first end 8 of the tube body to the end closure 10 at the second end 9 of the tube body 2. The label 11 moreover extends a little way 12 in over the tube shoulder 3 and also continues into the end closure 10.

In the example shown, the label 11 consists of a rectangular piece of material which has such dimensions that, in addition to extending over essentially the entire length of the tube 1, that is to say in the axial direction a of the tube, it also reaches all the way around the tube in its radial direction r. The label 11 is therefore adapted to the size of the tube so that it meets essentially edge to edge in the radial direction r without leaving a gap between the label edges. This means that it is possible to have text and/or decorative patterns extend continuously around the tube body without any visible join.

The label 11 is applied to the tube at the same time as the latter is formed by injection moulding in a mould. In this connection, the label 11 is retained on the inside of the wall of the mould by vacuum or by electrostatic forces during manufacture of the tube. The molten plastic material which forms the tube transfers heat to the label, which thus melts onto the outside of the tube. As mentioned previously, suitable label materials are thin, printable plastic films with a tensile strength in the axial direction of the tube which is at least 100 $N/mm^2$, preferably at least 150 $N/mm^2$, and most preferably at least 210 $N/mm^2$ measured according to DIN ISO 527-1/-3, an elongation at break which is at most 70%, preferably at most 50%, and most preferably at most 25% measured according to DIN ISO 527-1/-3, and a thickness of at most 90 μm and preferably of at most 75 μm. The plastic film used suitably also has a tensile strength in the radial direction which is at least 50 $N/mm^2$, preferably at least 80 $N/mm^2$, and most preferably at least 120 $N/mm^2$, and an elongation at break in the radial direction of at most 250%, preferably at most 200%, and most preferably at most 110%.

It is essential that the label 11 is sufficiently strong in the axial direction that it is not pulled apart during manufacture of the tube. At the same time, it is important that the label material is thin, so that it does not appreciably increase the thickness of the tube wall and in this way reduce the flexibility and squeezability of the tube and so that the heat transfer between the thin wall of the tube body and the label during manufacture of the tube is sufficient to bring about good adhesion between the label and the tube wall. Plastic films constructed from a number of layers and comprising at least one layer of oriented polypropylene have been found to be particularly suitable label materials.

Figure 2:
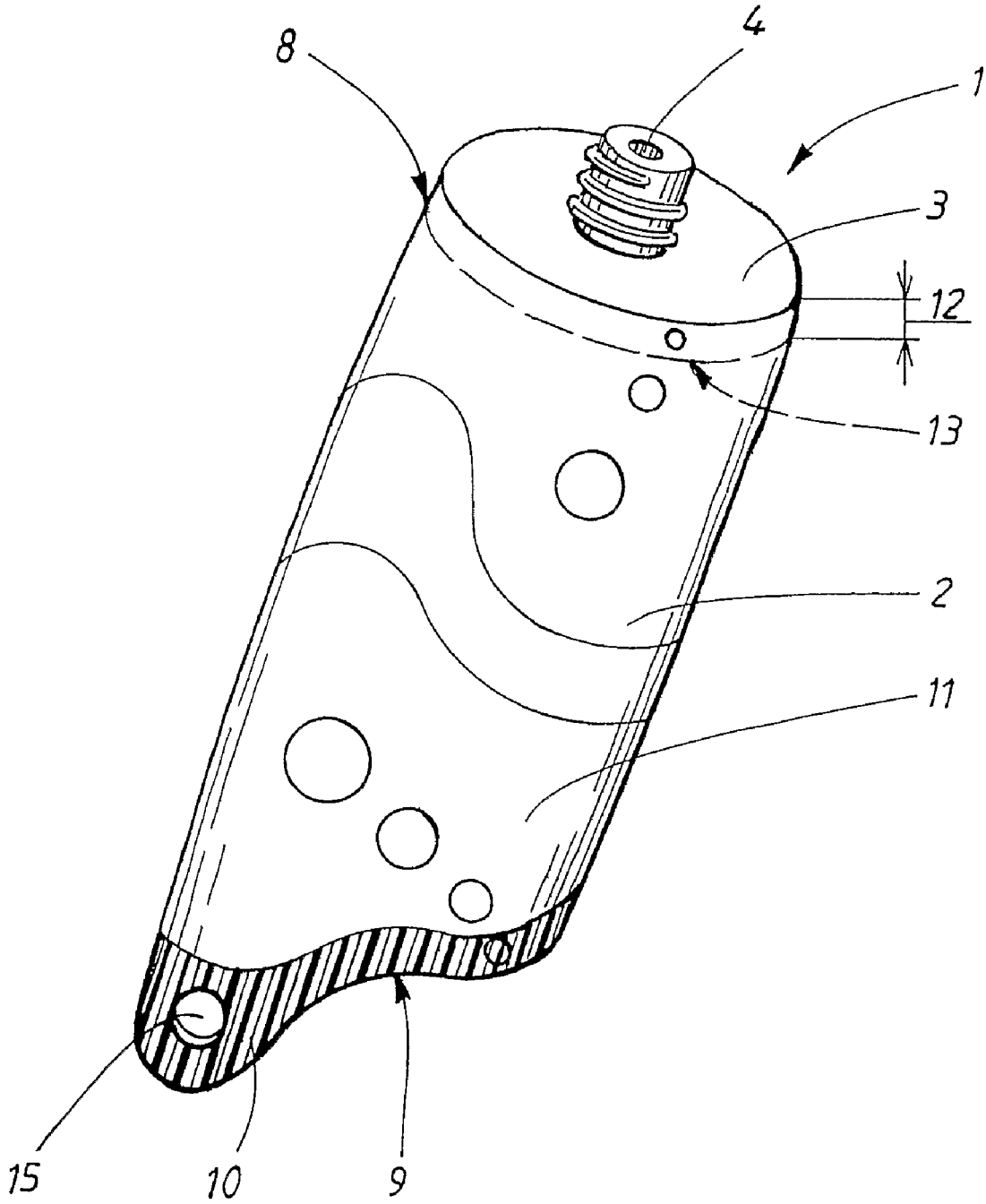
FIG. 2 shows a tube according to a second embodiment of the invention.

The tube 1 shown in FIG. 2 is broadly the same as the tube 1 in FIG. 1, and corresponding parts have therefore been given the same reference numbers as in FIG. 1. The tube 1 in FIG. 2 differs in that the tube does not have an attached lid. Instead, the dispensing opening 4 is adapted for closure by means of a screw cap (not shown).

Another difference is that the end closure in FIG. 2 is made as a curved weld. Such an embodiment is possible as the label 11 is applied simultaneously with the moulding of the tube 1, without synchronization between a curved edge on the tube body 2 and a curved edge on the label 11 being required. The label materials indicated above are fully weldable and consequently allow the label 11 to extend all the way into the weld. The shape shown of the end closure 10 is of course only an example. Any curved shape of the end closure 10 can consequently be used within the scope of the invention. It is also possible to use end closures which are made up of two or more unequal straight welds, for example in the form of a V, a zig-zag shape or the like.

In order to facilitate storage of the tube 1, the end closure 10 is provided with a hole 15, which can serve as a hanging device for hanging the tube, on a bathroom hook for example.

It is not necessary for the invention for the label to extend over such a large part of the surface of the tube 1 as in the examples shown in the figures. The label can consequently cover a smaller part of the tube in both the axial and the radial direction. The tube can also be provided with two or more labels which cover different parts of the tube.

The design of the dispensing opening 4 and the type of closing device used for it are of course without importance for the invention. Instead of the closing devices shown, it is of course possible to use a push-on cap, for example, or a cap which is inserted into the dispensing opening. There are also various types of safety caps which can be used if so desired.

The invention claimed is:

1. A method for the production of a thin-walled flexible plastic tube having an axial direction and a radial direction, said tube comprising a tube body with a tube shoulder with an emptying opening at a first end and a sealable end closure at a second end, said process comprising the steps of:

injection molding the tube having a tube body wall thickness of 0.3-1.2 mm while simultaneously applying a label to the tube by injecting melted plastics into a mold and retaining the label in the mold during the injection step, wherein flexibility of said tube allows a tube content comprising soft cheese or toothpaste to be squeezed out through the emptying opening when the end closure has been sealed, wherein said label comprises a plastic film with a tensile strength in the axial direction of the tube which is at least 100 $N/mm^2$ measured according to DIN ISO 527-1/-3, an elongation at break which is at most 70% measured according to DIN ISO 527-1/-3 and a thickness of at most 90 μm, wherein the plastic film has a greater tensile strength and lower tensile yield limit in an orientation direction than in a direction at right angles to the orientation direction, and wherein the plastic film is oriented such that the orientation direction coincides with the axial direction of the tube.

2. The method according to claim 1, wherein the label is a multilayer plastic film comprising at least one layer of oriented polypropylene, and wherein the method comprises the step of orienting the label such that the orientation direction coincides with the axial direction of the tube.

3. The method according to claim 1, wherein the plastic film has a tensile strength in the radial direction of the tube of at least 50 $N/mm^2$ and an elongation at break of at most 250%.

* * * * *